US008528358B2

(12) United States Patent
Taras et al.

(10) Patent No.: US 8,528,358 B2
(45) **Date of Patent: *Sep. 10, 2013**

(54) REFRIGERANT VAPOR INJECTION FOR DISTRIBUTION IMPROVEMENT IN PARALLEL FLOW HEAT EXCHANGER MANIFOLDS

(75) Inventors: Michael F. Taras, Fayetteville, NY (US); Alexander Lifson, Manlius, NY (US)

(73) Assignee: Carrier Corporation, Syracuse, NY (US)

( * ) Notice: Subject to any disclaimer, the term of this patent is extended or adjusted under 35 U.S.C. 154(b) by 887 days.

This patent is subject to a terminal disclaimer.

(21) Appl. No.: 12/443,845

(22) PCT Filed: Dec. 15, 2006

(86) PCT No.: PCT/US2006/047966

§ 371 (c)(1),
(2), (4) Date: Dec. 29, 2009

(87) PCT Pub. No.: WO2008/073111

PCT Pub. Date: Jun. 19, 2008

(65) Prior Publication Data

US 2010/0139313 A1 Jun. 10, 2010

(51) Int. Cl.
*F25B 1/00* (2006.01)

(52) U.S. Cl.
USPC ..... 62/498; 62/515

(58) Field of Classification Search
USPC ..... 62/498, 512, 515, 157, 126; 165/181, 165/182, 175, 178, DIG. 430
See application file for complete search history.

(56) References Cited

U.S. PATENT DOCUMENTS

| | | | | |
|---|---|---|---|---|
| 2,310,234 | A * | 2/1943 | Haug | 165/160 |
| 3,450,197 | A * | 6/1969 | Fieni | 165/142 |
| 3,675,710 | A * | 7/1972 | Ristow | 165/111 |
| 4,972,683 | A * | 11/1990 | Beatenbough | 62/507 |
| 5,095,972 | A * | 3/1992 | Nakaguro | 165/153 |
| 5,168,715 | A | 12/1992 | Nakao et al. | |
| 5,168,925 | A * | 12/1992 | Suzumura et al. | 165/176 |
| 5,752,566 | A * | 5/1998 | Liu et al. | 165/110 |
| 5,765,633 | A * | 6/1998 | Hu | 165/174 |

(Continued)

FOREIGN PATENT DOCUMENTS

| | | | |
|---|---|---|---|
| EP | 473888 | A1 | 3/1992 |
| EP | 886113 | A2 | 12/1998 |
| JP | 10332226 | A | 12/1998 |

OTHER PUBLICATIONS

Supplementary European Search dated Apr. 1, 2011.

(Continued)

*Primary Examiner* — Mohammad Ali
(74) *Attorney, Agent, or Firm* — Carlson, Gaskey & Olds

(57) ABSTRACT

Adequate distribution of a two-phase refrigerant flowing through a plurality of heat transfer tubes in a generally parallel manner is ensured. Tapping a portion of predominantly vapor refrigerant from an upstream location and delivering it to a downstream location where separation of liquid and vapor refrigerant phases is likely to occur and a liquid refrigerant phase is likely to accumulate. Additional momentum from the predominantly vapor refrigerant creates homogeneous conditions for the vapor/liquid refrigerant mixture, promoting uniform distribution of the mixture In downstream heat transfer tubes. The vapor refrigerant may be tapped from various locations.

20 Claims, 2 Drawing Sheets

(56) References Cited

U.S. PATENT DOCUMENTS

| | | | | |
|---|---|---|---|---|
| 5,988,267 | A * | 11/1999 | Park et al. | 165/110 |
| 6,047,556 | A | 4/2000 | Lifson | |
| 6,267,173 | B1 * | 7/2001 | Hu et al. | 165/132 |
| 6,318,118 | B2 | 11/2001 | Hanson et al. | |
| 6,341,648 | B1 * | 1/2002 | Fukuoka et al. | 165/144 |
| 7,000,415 | B2 | 2/2006 | Daddis, Jr. et al. | |
| 2004/0159121 | A1 * | 8/2004 | Horiuchi et al. | 62/526 |

OTHER PUBLICATIONS

International Preliminary Report mailed Jun. 29, 2011.

Search Report and Written Opinion mailed on Oct. 19, 2007 for PCT/US2006/47966.

* cited by examiner

REFRIGERANT VAPOR INJECTION FOR DISTRIBUTION IMPROVEMENT IN PARALLEL FLOW HEAT EXCHANGER MANIFOLDS

This application is a U.S. National Phase application of PCT Application No. PCT/US2006/047966 filed Dec. 15, 2006.

BACKGROUND OF THE INVENTION

This application relates to a parallel flow heat exchanger, wherein vapor refrigerant from an upstream location is utilized to provide additional momentum in driving liquid phase refrigerant along a manifold to improve refrigerant distribution among parallel tubes that are in fluid communication with this manifold, and thus enhance the heat exchanger and overall refrigerant system performance.

Refrigerant systems utilize a refrigerant to condition a secondary fluid, such as air, delivered to a climate controlled space. In a basic refrigerant system, the refrigerant is compressed in a compressor, and flows downstream to a condenser, where heat is typically rejected from the refrigerant to ambient environment, during heat transfer interaction with this ambient environment. Then refrigerant flows through an expansion device, where it is expanded to a lower pressure and temperature, and to an evaporator, where during heat transfer interaction with a secondary fluid (e.g., indoor air), the refrigerant is evaporated and typically superheated, while cooling and often dehumidifying this secondary fluid.

In recent years, much interest and design effort has been focused on the efficient operation of the heat exchangers (condenser and evaporator) in the refrigerant systems. One relatively recent advancement in the heat exchanger technology is the development and application of parallel flow, or so-called microchannel or minichannel, heat exchangers (these two terms will be used interchangeably throughout the text), as the condensers and evaporators.

These heat exchangers are provided with a plurality of parallel heat transfer tubes, typically of a non-round shape, among which refrigerant is distributed and flown in a parallel manner. The heat transfer tubes are orientated generally substantially perpendicular to a refrigerant flow direction in the inlet, intermediate and outlet manifolds that are in flow communication with the heat transfer tubes. The primary reasons for the employment of the parallel flow heat exchangers, which usually have aluminum furnace-brazed construction, are related to their superior performance, high degree of compactness, structural rigidity and enhanced resistance to corrosion.

When utilized in condenser applications, these heat exchangers are normally designed for a multi-pass configuration, typically with a plurality of parallel heat transfer tubes within each refrigerant pass, in order to obtain superior performance by balancing and optimizing heat transfer and pressure drop characteristics. In such designs, the refrigerant that enters an inlet manifold (or so-called inlet header) travels through a first multi-tube pass across a width of the condenser to an opposed, typically intermediate, manifold. The refrigerant collected in a first intermediate manifold reverses its direction, is distributed among the heat transfer tubes in the second pass and flows to a second intermediate manifold. This flow pattern can be repeated for a number of times, to achieve optimum condenser performance, until the refrigerant reaches an outlet manifold (or so-called outlet header). Typically, the individual manifolds are of a cylindrical shape (although other shapes are also known in the art) and are represented by different chambers separated by partitions within the same manifold construction assembly.

Heat transfer corrugated and typically louvered fins are placed between the heat transfer tubes for outside heat transfer enhancement and construction rigidity. These fins are typically attached to the heat transfer tubes during a furnace braze operation. Furthermore, each heat transfer tube preferably contains a plurality of relatively small parallel channels for in-tube heat transfer augmentation and structural rigidity.

However, there have been some obstacles to the use of the parallel flow heat exchangers in a refrigerant system. In particular, a problem, known as refrigerant maldistribution, typically occurs in the microchannel heat exchanger manifolds when the two-phase flow enters the manifold. A vapor phase of the two-phase flow has significantly different properties, moves at different velocities and is subjected to different effects of internal and external forces than a liquid phase. This causes the vapor phase to separate from the liquid phase and flow independently. The separation of the vapor phase from the liquid phase has raised challenges, such as refrigerant maldistribution in parallel flow heat exchangers. This phenomenon takes place due to unequal pressure drop inside the channels and in the inlet and outlet manifolds, as well as poor manifold and distribution system design. In the manifolds, the difference in length of refrigerant paths, phase separation and gravity are the primary factors responsible for maldistribution. Inside the heat exchanger channels, variations in the heat transfer rate, airflow distribution, manufacturing tolerances, and gravity are the dominant factors. Furthermore, a recent trend of heat exchanger performance enhancement promoted miniaturization of its channels, which in turn negatively impacted refrigerant distribution. Since it is extremely difficult to control all these factors, along with the complexity and inefficiency of the proposed techniques or prohibitively high cost of the solutions, many of the previous attempts to manage refrigerant distribution, have failed.

On the other hand, refrigerant maldistribution may causes significant heat exchanger and overall system performance degradation over a wide range of operating conditions. Therefore, it would be desirable to reduce or eliminate refrigerant maldistribution in parallel flow heat exchangers.

SUMMARY OF THE INVENTION

In a disclosed embodiment of this invention, refrigerant vapor is tapped from an upstream location, and directed into a location in a parallel flow heat exchanger intermediate manifold where two-phase refrigerant flow is present, and a liquid phase is likely to separate from a vapor phase and accumulate, causing refrigerant maldistribution in the downstream heat transfer tubes that are in fluid communication with this intermediate manifold. The refrigerant vapor from an upstream location has a higher velocity and enough momentum to create predominantly homogeneous flow conditions, while mixing, atomizing and redistributing the initially separated two-phase refrigerant in the intermediate manifold.

In one embodiment the vapor refrigerant is tapped from a line connecting a compressor to the parallel flow heat exchanger.

In another embodiment, the predominantly vapor or homogeneous two-phase refrigerant is tapped from a location in an upstream manifold and redirected to a location in a downstream manifold.

In further features, the flow of the refrigerant vapor may be pulsed or periodically modulated to enhance the refrigerant distribution effects. Also, multiple taps may be utilized to tap a portion of refrigerant from the same manifold and redirect it to different downstream manifolds. On the other hand, a portion of refrigerant from different upstream manifolds may be delivered to the same downstream manifold.

Furthermore, the disclosed invention can be implemented in parallel flow heat exchanger installations functioning as condensers as well as evaporators.

These and other features of the present invention can be best understood from the following specification and drawings, the following of which is a brief description.

DETAILED DESCRIPTION OF THE PREFERRED EMBODIMENTS

Figure 1:
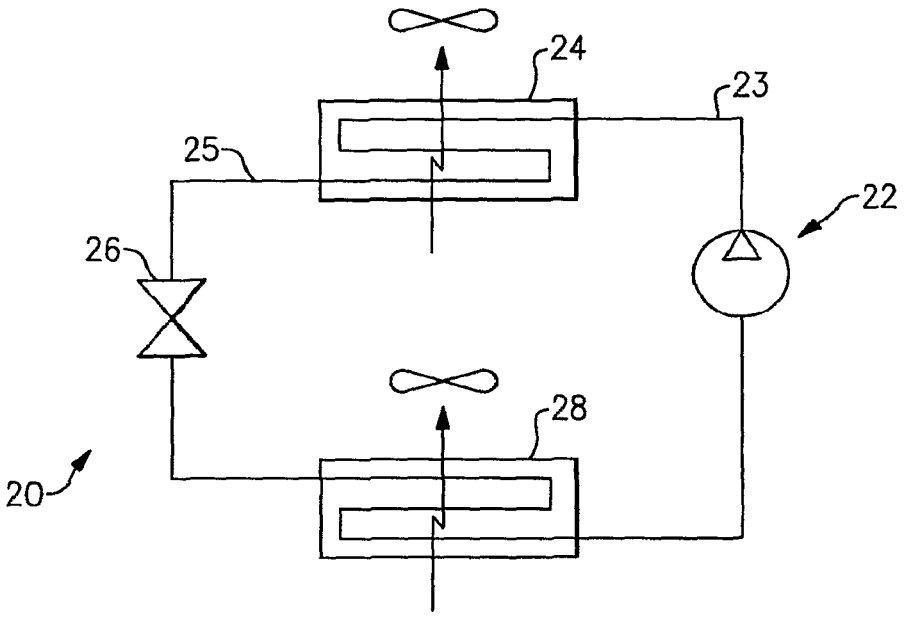
FIG. 1 shows a refrigerant system incorporating the present invention.

A basic refrigerant system 20 is illustrated in FIG. 1 and includes a compressor 22 delivering refrigerant into a discharge line 23 heading to a condenser 24. The condenser 24 is a parallel flow heat exchanger, and in one disclosed embodiment is a microchannel heat exchanger. The heat is transferred in the condenser 24 from the refrigerant to a secondary loop fluid, such as air. The high pressure, but desuperheated, condensed and typically cooled, refrigerant passes into a liquid line 25 downstream of the condenser 24 and through an expansion device 26, where it is expanded to a lower pressure and temperature. Downstream of the expansion device 26, refrigerant flows through an evaporator 28 and back to the compressor 22. Although a basic refrigerant system 20 is shown in FIG. 1, it is well understood by a person ordinarily skilled in the art that many options and features may be incorporated into a refrigerant system design. All these refrigerant system configurations are well within the scope and can equally benefit from the invention.

Figure 2A:
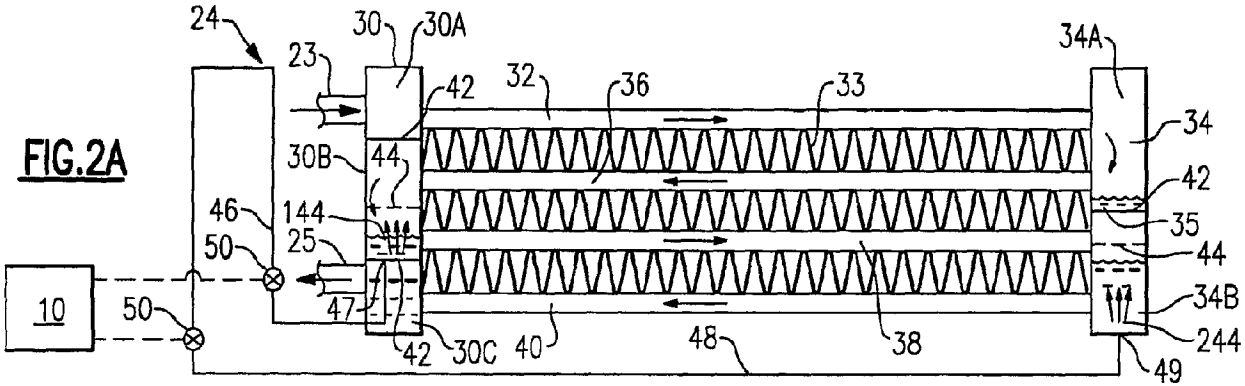
FIG. 2A is a first schematic of a heat exchanger incorporating the present invention.

As shown in FIG. 2A, the condenser 24 has a manifold structure 30 that consists of multiple chambers 30A, 30B and 30C. An inlet manifold chamber 30A receives the refrigerant, typically in a vapor phase, from the discharge line 23. The refrigerant flows into a first bank of parallel heat transfer tubes 32, and then across the condenser core to a chamber 34A of an intermediate manifold structure 34. It should be noted that in practice there may be more or less refrigerant passes than the four illustrated passes 32, 36, 38, and 40. Further, it should be understood that, although for simplicity purposes each refrigerant pass is represented by a single heat transfer tube, typically there are many heat transfer tubes within each pass amongst which refrigerant is distributed while flowing within the pass, and, in the condenser applications, a number of the heat transfer tubes within each bank typically decreases in a downstream direction with respect to a refrigerant flow. For instance, there could be 12 heat transfer tubes in the first bank, 8 heat transfer tubes in a second bank, 5 heat transfer tubes in a third bank and only 2 heat transfer tubes in the last forth bank. A separator plate 42 is placed within the manifold 34 to separate the chamber 34A from a chamber 34B positioned within the same manifold structure 34.

As shown in the FIG. 2A at this location, the refrigerant is starting to condense while flowing through the first pass along the tubes 32 (due to heat transfer interaction with a secondary fluid) and is in a two-phase thermodynamic state, although typically with a relatively small liquid amount in a two-phase mixture. Also, at this location, liquid phase may be starting to separate from the vapor refrigerant, as shown by 35, since liquid and vapor phases have different thermophysical properties and are affected differently by external forces such as gravity and momentum sheer. Separation of liquid and vapor phases may create maldistribution conditions, while the refrigerant flows from a chamber 34A of the intermediate manifold structure 34 back across the core of the condenser 24 through a second bank of parallel heat transfer tubes 36 into a chamber 30B of the manifold structure 30.

Since, in many cases, a somewhat insignificant amount of liquid refrigerant is accumulated within the chamber 34A, refrigerant maldistribution does not have a profound effect on the performance of the condenser 24 yet, and no special measures may be required (although, in some cases, special design provisions may be implemented). The refrigerant in the second bank of heat transfer tubes 36 is flowing in generally parallel (although counterflow) direction to the refrigerant flow in the first bank of heat transfer tubes 32. As shown in the FIG. 2A, a separator plate 42 prevents refrigerant mixing or direct flow communication between the manifold chambers 30A and 30B. In the chamber 30B, the refrigerant is also in a two-phase thermodynamic state but containing lower vapor quality and potentially promoting the conditions for liquid refrigerant accumulation, as shown at 144, at the bottom of the chamber 30B.

In such circumstances, vapor refrigerant will predominantly flow into the upper portion of the heat transfer tubes of the third pass 38 with liquid refrigerant flowing through the lower portion of the third bank 38 of heat transfer tubes. Therefore, refrigerant maldistribution may have a profound effect on performance of the condenser 24.

The refrigerant flows from the intermediate chamber 30B of the manifold structure 30 into a third bank of parallel heat transfer tubes 38 generally positioned in parallel arrangement to the first and second banks of heat transfer tubes 32 and 36, across the condenser 24 and into an intermediate chamber 34B of the manifold structure 34. The liquid refrigerant level in the manifold chamber 34B, as shown at 244, is even higher than in the chambers 34A and 30B.

The refrigerant flowing through the chamber 34B has even lower vapor quality and potentially creating similar maldistribution conditions for the fourth (and last) bank of heat transfer tubes 40. Again, a separator plate 42 positioned between the chambers 30B and 30C ensures the refrigerant flow in the desired downstream direction without short-circuiting or bypass. From the chamber 30C, the liquid refrigerant exits condenser 24 through the liquid line 25. As known, corrugated, and typically louvered, fins 33 are located between and attached to the heat transfer tubes (typically during a furnace brazing process) to extend the heat transfer surface and improve structural rigidity of the condenser 24.

Figure 2B:
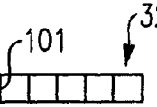
FIG. 2B shows a cross-sectional view of a heat exchanger tube.

As shown in FIG. 2B, the heat transfer tubes within the tube banks 32, 36, 38, and 40 may consist of a plurality of parallel channels 100 separated by walls 101. The FIG. 2B is cross-sectional view of the heat transfer tubes shown in FIG. 2A. The channels 100 allow for enhanced heat transfer characteristics and assist in improved structural rigidity. The cross-section of the channels 100 may take different forms, and although illustrated as a rectangular in FIG. 2B, may be, for instance, of triangular, trapezoidal or circular configurations.

In the present invention, refrigerant is tapped from the discharge line 23 into a line 46 and directed to a location 47, that may or may not be directly associated with the separator plate 42 dividing the chambers 30B and 30C, where a significant amount of accumulated liquid refrigerant 144 is expected (e.g., due to separation under gravity force). This high pressure compressed refrigerant vapor will tend to mix (creating more homogeneous conditions) and redistribute the liquid refrigerant phase amongst the third bank of the heat transfer tubes 38 in more uniform manner.

Similarly, another line 48 may be directed to a location 49, providing favorable conditions for more uniform distribution of the liquid refrigerant phase 244 within the manifold chamber 34B and amongst the forth bank of the heat transfer tubes 40. Valves 50 associated with a control 10 may be placed on the lines 46 and/or 48 to allow the flow of this discharge gas to be pulsed, modulated or completely shutdown. In this manner, a refrigerant system designer can achieve precise control over the desired amount of bypassed high pressure refrigerant vapor, which can be tailored, for instance, to specific operating conditions, to provide uniform distribution of liquid and vapor refrigerant phases amongst the heat transfer tubes.

It should be understood that the liquid levels 35, 144 and 244 may be somewhat exaggerated to illustrate the concept of the present invention as well as may vary with operating and environmental conditions.

Also, as shown in FIG. 2A, perforated screen plates 44, may be utilized in conjunctions with the bypass lines 46 and 48 and placed within the manifold chambers 30B and 34B to prevent droplets of liquid interfering with the refrigerant flow exiting an upstream bank of heat transfer tubes. Therefore, performance degradation of the condenser coil 24 due to refrigerant maldistribution will be minimal or entirely eliminated.

Figure 3B:
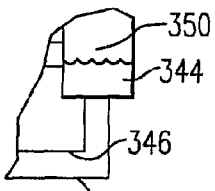
FIG. 3B shows another schematic.
Figure 3A:
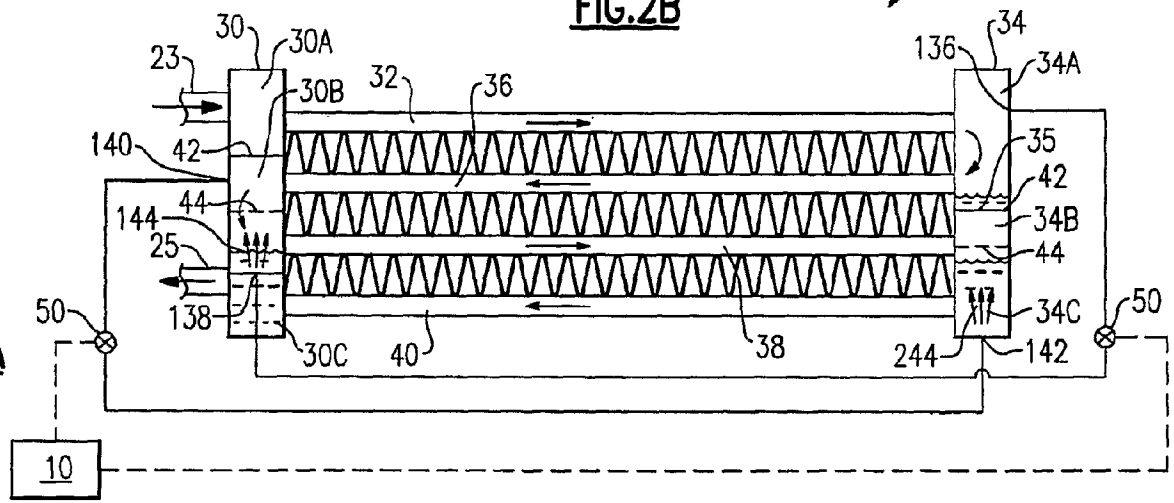
FIG. 3A is a second schematic of a heat exchanger incorporating the present invention.

FIG. 3A shows another embodiment 124 wherein the parallel flow heat exchanger construction is similar to the heat exchanger shown in FIG. 2A. However, a portion of the refrigerant vapor is tapped at a point 136 from a location in the chamber 34A of the intermediate manifold structure 34 upstream of a point 138 in the chamber 30B of the manifold structure 30, where a small portion of the refrigerant vapor is redirected from the chamber 34A to the chamber 30B to improve refrigerant distribution in the chamber 30B and amongst the heat transfer tubes in the bank 38. Similarly, a small portion of the refrigerant vapor tapped from a point 140 in the chamber 30B of the manifold structure 30 can be utilized to improve distribution in the chamber 34C and the heat transfer tubes in the bank 40, and is directed to a point 142 within the chamber 34C.

The multiple taps in FIGS. 2A and 3A deliver a small portion of predominantly vapor refrigerant to different locations within the condenser. FIG. 3B shows separate taps 346 and 348, which deliver still relatively small amounts of predominantly vapor refrigerant form separate locations within the condenser to a common location 350, such as one of the intermediate manifold chambers, having certain amount of accumulated liquid refrigerant 344, in order to assist in uniform distribution of this liquid refrigerant among the heat transfer tubes fluidly connected to this manifold chamber and positioned downstream in relation to refrigerant flow. Similarly, the small amounts of predominantly vapor refrigerant may be delivered from the same upstream location to different downstream locations to improve distribution of two-phase refrigerant at those downstream locations.

Figure 4:
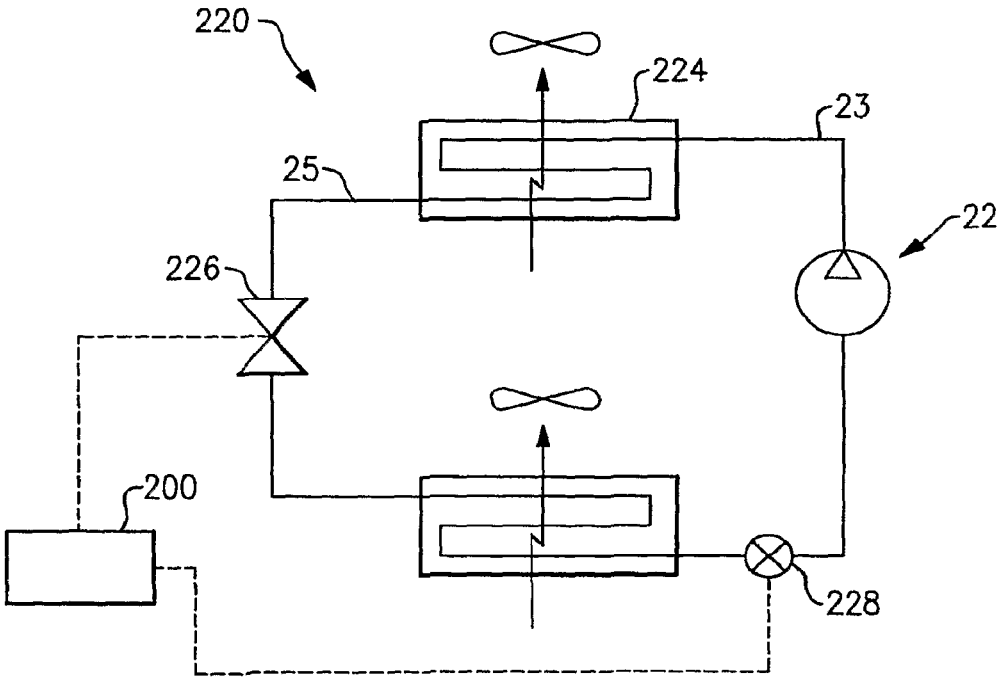
FIG. 4 shows yet another embodiment.

FIG. 4 shows yet another embodiment 220, where there is no refrigerant re-routing is taking place, and instead the mixing between the vapor and liquid phases is accomplished by pulsing the main refrigerant flow through the parallel flow heat exchanger. The pulsing of the main flow is accomplished by periodically changing the size of the opening of the flow control device, such as electronically controlled expansion valve 226. When the refrigerant flow through the expansion valve 226 is throttled (the opening of the valve is decreased in size), pressure in the condenser 224 is built up, and when the expansion valve 226 is opened wider, the pressure in the condenser 224 is reduced. The varying pressure in the condenser 224 will result in fluctuating refrigerant velocities in the condenser, which in turn will enhance the uniform refrigerant distribution effects by providing mixing of liquid and vapor phases.

The pulsing of the main refrigerant can also be accomplished by using, for example, a flow control device installed between the evaporator and compressor. In this case, the function of such flow control device can be combined with a function of so-called suction modulation valve (SMV) 228 that is often installed in refrigeration units to selectively reduce the unit capacity by throttling the flow at the compressor suction to control the amount of refrigerant reaching the compressor. A smaller amount of opening through the SMV valve allows less refrigerant to be delivered to the compressor. The SMV 228 can be rapidly cycled (opened and closed) to generate pulses of refrigerant through the condenser 224, with the pulsing refrigerant flow in turn enhancing the mixing of liquid and vapor refrigerant phases in the condenser 224 in a similar fashion as it was accomplished by the electronic expansion valve 226. Both, an electronic expansion valve and a suction modulation valve, can be utilized individually or in combination with each other and controlled by a controller 200 that would selectively open and close these valves to enhance the mixing of the vapor and liquid refrigerant phases. The suction modulation valve 228 can be substituted, for example, by a solenoid valve which would cycle between open and closed position (some limited amount of flow still might be permitted through the valve in its closed position to prevent compressor suction approaching deep vacuum). Further, it has to be understood that other location for such flow control devices are feasible within the refrigerant system. Analogously, for instance, a valve located on the discharge refrigerant line or liquid refrigerant line can perform the same function and may be controlled in a similar manner.

In summary, the present invention utilizes a small portion of predominantly vapor refrigerant from an upstream location, such as a discharge line or upstream manifold, and redirects this refrigerant to a location within a parallel flow heat exchanger, such as an intermediate manifold, downstream along the refrigerant path, where the vapor and liquid phase separation is likely to occur. This high pressure vapor refrigerant allows for better mixing and promotes homogeneous conditions for a two-phase refrigerant, such that maldistribution is appreciably reduced or eliminated for a refrigerant entering a downstream bank of heat transfer tubes positioned generally in a parallel arrangement.

While the main focus of the invention is on the condenser applications, refrigerant system evaporators can also benefit from the invention. In the case of an evaporator, a small portion of refrigerant vapor would be redirected to an inlet or intermediate manifolds from any number of a higher pressure locations within the refrigerant system, such as a discharge line, condenser manifolds, etc. The flow pulsing, though illustrated for the condenser heat exchangers, can be used in a similar fashion as described above to enhance refrigerant distribution in the evaporator heat exchangers. While the invention is disclosed for parallel flow heat exchangers, it does have applications for other heat exchanger types, for instance, for the heat exchangers having intermediate manifolds in the condenser applications. Also, the four-pass heat exchangers of FIGS. 2A and 3A are purely exemplary, and a heat exchanger with any number of passes can equally benefit from the present invention. Also, the manifold constructions 30 and 34 encompassing a number of chambers may have many different design shapes and configurations. Also, the manifold chambers may not necessarily be positioned within the same manifold construction. Lastly, the separator plates 42 can be replaced by check valves or solenoid valves.

Although a preferred embodiment of this invention has been disclosed, a worker of ordinary skill in the art would recognize that certain modifications would come within the scope of this invention. For that reason the following claims should be studied to determine the true scope and content of this invention.

What is claimed is:

1. A refrigerant system comprising:

a compressor, said compressor delivering a compressed refrigerant to a condenser, refrigerant from said condenser passing through an expansion device, and from said expansion device through an evaporator, and from said evaporator being returned to said compressor; and at least one of said condenser and said evaporator having a plurality of heat transfer tubes which pass a refrigerant downstream in a generally parallel manner; and at least one downstream location within said at least one said condenser and said evaporator being likely to receive a separated liquid and vapor phases of refrigerant mixture as the refrigerant flows through the plurality of heat transfer tubes, and a portion of predominantly vapor refrigerant being tapped from an upstream location and delivered to said downstream location to improve distribution of said vapor and liquid refrigerant mixture amongst said plurality of said heat transfer tubes.

2. The refrigerant system as set forth in claim 1, wherein said at least one of said condenser and said evaporator has at least one manifold structure in fluid communication with said plurality of heat transfer tubes, said at least one manifold structure being provided with at least one separation member providing at least two chambers within said at least one manifold structure, and at least one of said manifold chambers being said downstream location.

3. The refrigerant system as set forth in claim 2, wherein said separation member is one of a separation plate, a check valve and a solenoid valve.

4. The refrigerant system as set forth in claim 2, wherein said heat exchanger is the condenser and said upstream location is at least one of a discharge line, an inlet manifold chamber and an upstream intermediate manifold chamber.

5. The refrigerant system as set forth in claim 2, wherein said heat exchanger is the condenser and said downstream location is an intermediate manifold chamber.

6. The refrigerant system as set forth in claim 2, wherein said heat exchanger is the evaporator and said upstream location is at least one of a discharge line, an inlet evaporator manifold chamber, an upstream intermediate evaporator manifold chamber, an inlet condenser manifold chamber, and an intermediate condenser manifold chamber.

7. The refrigerant system as set forth in claim 2, wherein said heat exchanger is the evaporator and said downstream location is at least one of an inlet manifold chamber and an intermediate manifold chamber.

8. The refrigerant system as set forth in claim 1, wherein there are a plurality of taps from a predominantly the same upstream location which deliver said predominantly vapor refrigerant to different downstream locations.

9. The refrigerant system as set forth in claim 1, wherein there are a plurality of taps from different upstream locations which deliver said predominantly vapor refrigerant to a predominantly the same downstream location.

10. The refrigerant system as set forth in claim 1, wherein a valve on a tap line allows said tapped predominantly vapor refrigerant flow to be controlled by pulsing or modulating said valve.

11. The refrigerant system as set forth in claim 10, wherein said pulsation or modulation flow control for said tapped predominantly vapor refrigerant is defined by operating conditions of the refrigerant system.

12. The refrigerant system as set forth in claim 1, wherein said plurality of heat transfer tubes have external corrugated heat transfer fins in heat transfer communication with said heat transfer tubes.

13. The refrigerant system as set forth in claim 1, wherein each of said plurality of heat transfer tubes includes a plurality of small parallel internal channels carrying refrigerant in parallel paths within said heat transfer tubes.

14. The refrigerant system as set forth in claim 13, wherein said parallel internal channels create a microchannel heat transfer tube or a minichannel heat transfer tube.

15. The refrigerant system as set forth in claim 13, wherein said parallel internal channels have at least one of circular, rectangular, trapezoidal or triangular configuration.

16. A refrigerant system comprising:

a compressor, said compressor delivering a compressed refrigerant to a condenser, refrigerant from said condenser passing through an expansion device, and from said expansion device through an evaporator, and from said evaporator being returned to said compressor; and at least one of said condenser and said evaporator having a plurality of heat transfer tubes which pass a refrigerant downstream in a generally parallel manner; and at least one downstream location within said at least one said condenser and said evaporator being likely to receive a separated liquid and vapor phases of refrigerant mixture as the refrigerant flows through the plurality of heat transfer tubes, and a control operating such that said refrigerant is pulsed as it passes through said at least one condenser and said evaporator to minimize the separation of liquid and vapor refrigerant phases.

17. The refrigerant system as set forth in claim 16, wherein said refrigerant being pulsed by selectively opening and closing a flow control device located between the said condenser and said evaporator.

18. The refrigerant system as set forth in claim 17 wherein said flow control device is an electronic expansion valve.

19. The refrigerant system as set forth in claim 16, wherein said refrigerant being pulsed by selectively opening and closing a flow control device located between the evaporator and the compressor.

20. The refrigerant system as set forth in claim 19, wherein said flow control device is one of a solenoid valve and a suction modulation valve.

* * * * *